US008523006B2

(12) United States Patent
Barbier

(10) Patent No.: US 8,523,006 B2
(45) Date of Patent: Sep. 3, 2013

(54) CONTAINER WITH INTEGRATED STRUCTURAL REINFORCEMENT

(75) Inventor: Marco Tulio Barbier, Dover, MA (US)

(73) Assignee: EasyPak LLC, Loeminster, MA (US)

( * ) Notice: Subject to any disclaimer, the term of this patent is extended or adjusted under 35 U.S.C. 154(b) by 0 days.

(21) Appl. No.: 13/152,609

(22) Filed: Jun. 3, 2011

(65) Prior Publication Data

US 2012/0168449 A1 Jul. 5, 2012

Related U.S. Application Data

(60) Provisional application No. 61/427,995, filed on Dec. 29, 2010.

(51) Int. Cl.
*B65D 6/00* (2006.01)

(52) U.S. Cl.
USPC ..... 220/669; 220/4.26; 220/23.6; 220/781; 206/499; 206/503; 206/821

(58) Field of Classification Search
USPC ..... 220/4.26, 23.6, 781, 380, 406, 669; 206/499, 503, 504, 508, 821
See application file for complete search history.

(56) References Cited

U.S. PATENT DOCUMENTS

| | | | | | |
|---|---|---|---|---|---|
| 5,456,379 | A * | 10/1995 | Krupa et al. | ..... | 220/835 |
| D409,085 | S * | 5/1999 | Wyslotsky et al. | ..... | D9/425 |
| D433,334 | S * | 11/2000 | Hayes et al. | ..... | D9/452 |
| 7,546,932 | B2 * | 6/2009 | Smith et al. | ..... | 220/675 |
| D677,150 | S * | 3/2013 | Barbier | ..... | D9/424 |
| 2005/0173287 | A1 * | 8/2005 | Smith et al. | ..... | 206/520 |
| 2009/0145900 | A1 * | 6/2009 | Maroofian et al. | ..... | 220/200 |
| 2011/0031154 | A1 * | 2/2011 | Overgaag et al. | ..... | 206/509 |

* cited by examiner

*Primary Examiner* — Mickey Yu
*Assistant Examiner* — Kareen Rush
(74) *Attorney, Agent, or Firm* — Barlow, Josephs & Holmes, Ltd.

(57) ABSTRACT

The structurally reinforced container includes a base having a bottom, side walls, corners and a top peripheral edge defining an open top end. A number of ridges are formed in at least one of the side walls and corners. The ridges are in the configuration of at least one arch that has an apex where the apex of the at least one arch is proximal to the open top end of the base. A lid resides in communication with the top peripheral edge of the base to releasably close the top end of the base. The integrated arches provide reinforcement to the base of the container to increase top load resistance without increasing the thickness of the material used.

2 Claims, 5 Drawing Sheets

CONTAINER WITH INTEGRATED STRUCTURAL REINFORCEMENT

CROSS REFERENCE TO RELATED APPLICATION

This application is related to and claims priority from earlier filed provisional patent application Ser. No. 61/427,995, filed Dec. 29, 2010, the entire contents thereof is incorporated herein by reference.

BACKGROUND OF THE INVENTION

The invention relates generally to containers, such as those in the configuration of packages and tubs, which may or may not have a lid. More specifically, the present invention relates to such containers that are used to store articles, such as food.

It is well known in the art that containers are commonly used to store food, but it should be understood that the invention relates to any type of container for any type of purpose.

For many types of containers, there is a desire to make the structure, including the walls, as rigid as possible. However, there needs to be some additional elements or materials to achieve this, which adds cost. For example, it is common to include carbon fiber or metal reinforcement members, which not only adds complexity to the manufacturing process but also adds significant cost. Also, it is possible to simply make the walls of the container thicker, which, similarly, adds costs in view of the use of additional material usage. Thus, there is a balancing between amount and nature of material used and the rigidity of the container. This is particularly true with containers that are made of plastic material using a forming process, such as thermoforming or injection molding.

In view of the above, the prior art attempts in the prior art are not adequate as they add undesirably complexity and cost to the manufacture of these containers.

In view of the foregoing, there is a demand for a container that is the same as or less expensive than prior art containers yet are more rigid with an increased resistance to top load which allows for an increase in stack weight on the top of the container or tub.

There is a need for a container that uses less material with thinner walls yet provides superior rigidity for increased top load capability, i.e. ability to support larger weight with more items stacked thereon.

SUMMARY OF THE INVENTION

The present invention preserves the advantages of prior art containers and tubs. In addition, it provides new advantages not found in currently available containers and tubs and overcomes many disadvantages of such currently available containers and tubs.

The invention is generally directed to the novel and unique container (i.e. a tub) that can support a higher top load yet has thinner walls so that less material can be used yet the increased resistance to top load can still be achieved.

More specifically, the present invention provides a structurally reinforced container that includes a base having a bottom, side walls, corners and a top peripheral edge defining an open top end. A plurality of ridges formed in at least one of the side walls and corners. The ridges are in the configuration of at least one arch having an apex where the apex of the at least one arch is proximal to the open top end of the base. A resides in communication with the top peripheral edge of the base to releasably close the top end of the base. As a result, the arches provide reinforcement to the base of the container to increase top load resistance.

Many different configurations of the present invention are possible. It is possible that at least one arch is provided on each of the side walls and the corners. It is also possible that the base has four side walls and four corners and one arch is located on each side wall and each corner of the base. The arches may or may not overlap and may be in any number.

It is therefore an object of the present invention to provide a container that has increased resistance top load weight.

Another object of the present invention is to provide a container that has thinner walls than prior art containers yet still provides top load resistance.

A further object of the present invention is to provide a container that includes an engineered geometry so that superior top load capability can be achieved with thinner material walls.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
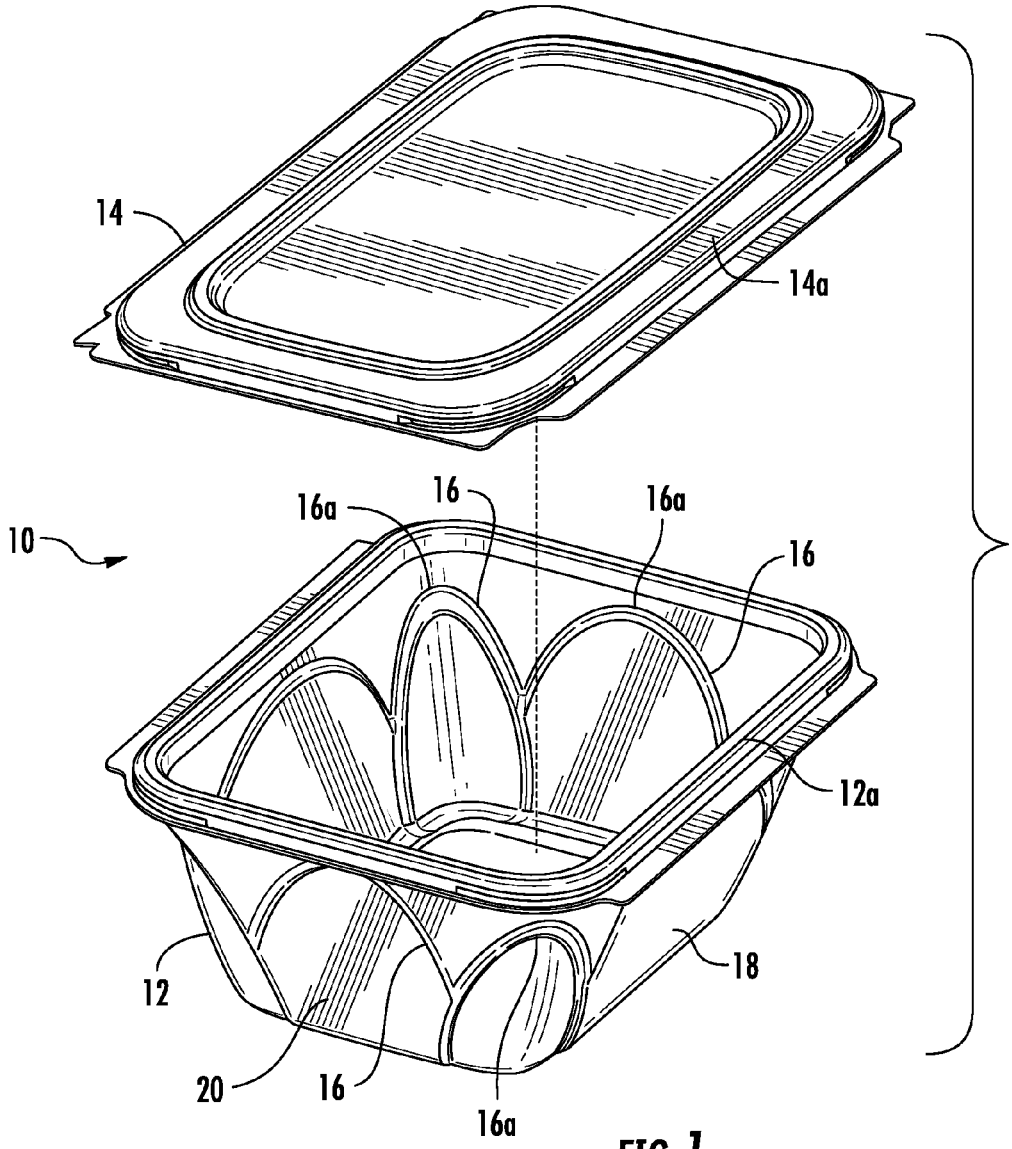
FIG. 1 is a front perspective view of the container, with base and lid, of the present invention.

Referring first to FIG. 1, the container 10 of the present invention is shown to include a base 12 and a lid 14. In accordance with the present invention, a number of arches 16 are integrated into the wall geometry of the base 12 where the apex 16*a* of the arches 16 receives the downward forces from the weight of any object stacked on the top thereof. The arches 16 are formed by creating ridges in the wall using thermoforming techniques, such as providing the appropriate tooling to create such ridges, where desired. The present invention incorporates the structural advantages of arches, such as in bridges, into a container for improving the structural integrity thereof.

The lid 14 is provided on the top of the base 12 of the container 10, with the items to be stored residing therein, such as food or the like (not shown). Preferably, the lid 14 snaps onto the base for engagement of the peripheral top edge 12*a* of the base 12 with peripheral edge 14*a* of the lid 14 to provide a seal. Further details of such interconnection need not be discussed herein as these interconnections are very well known in the art.

Figure 2:
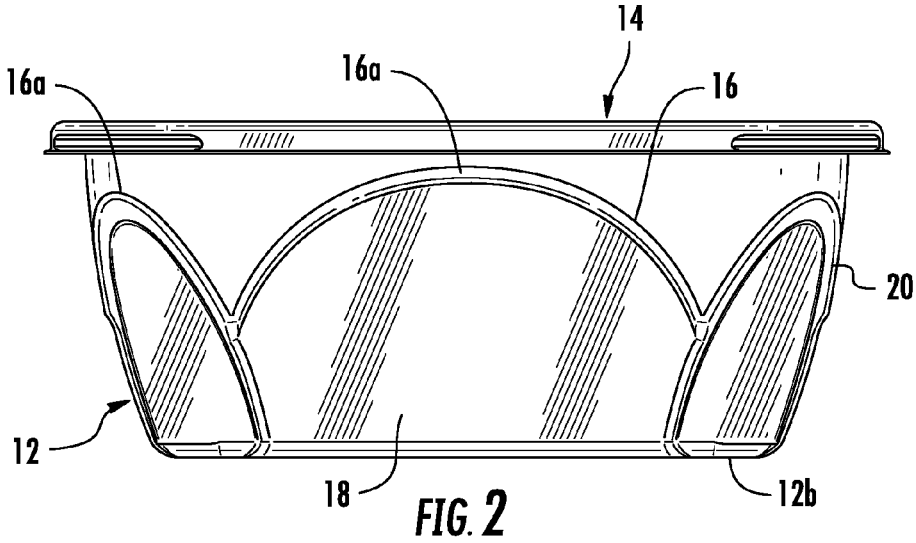
FIG. 2 is a front view of the container of FIG. 1.
Figure 3:
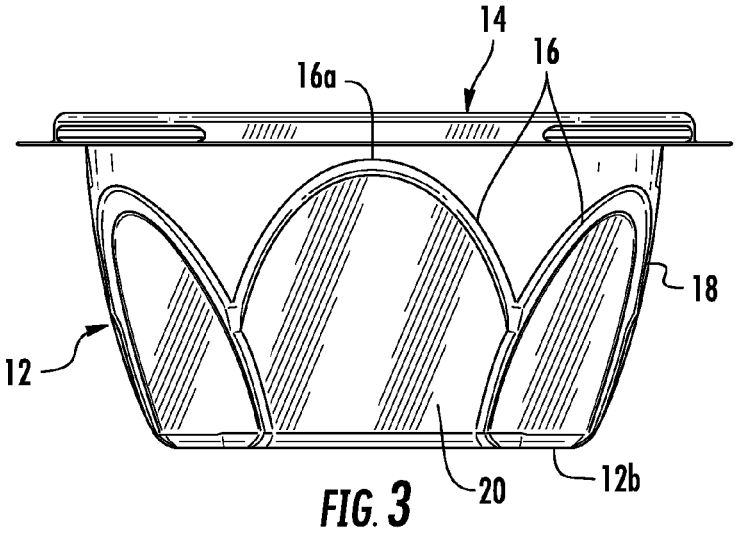
FIG. 3 is a side view of the container of FIG. 1.
Figure 4:
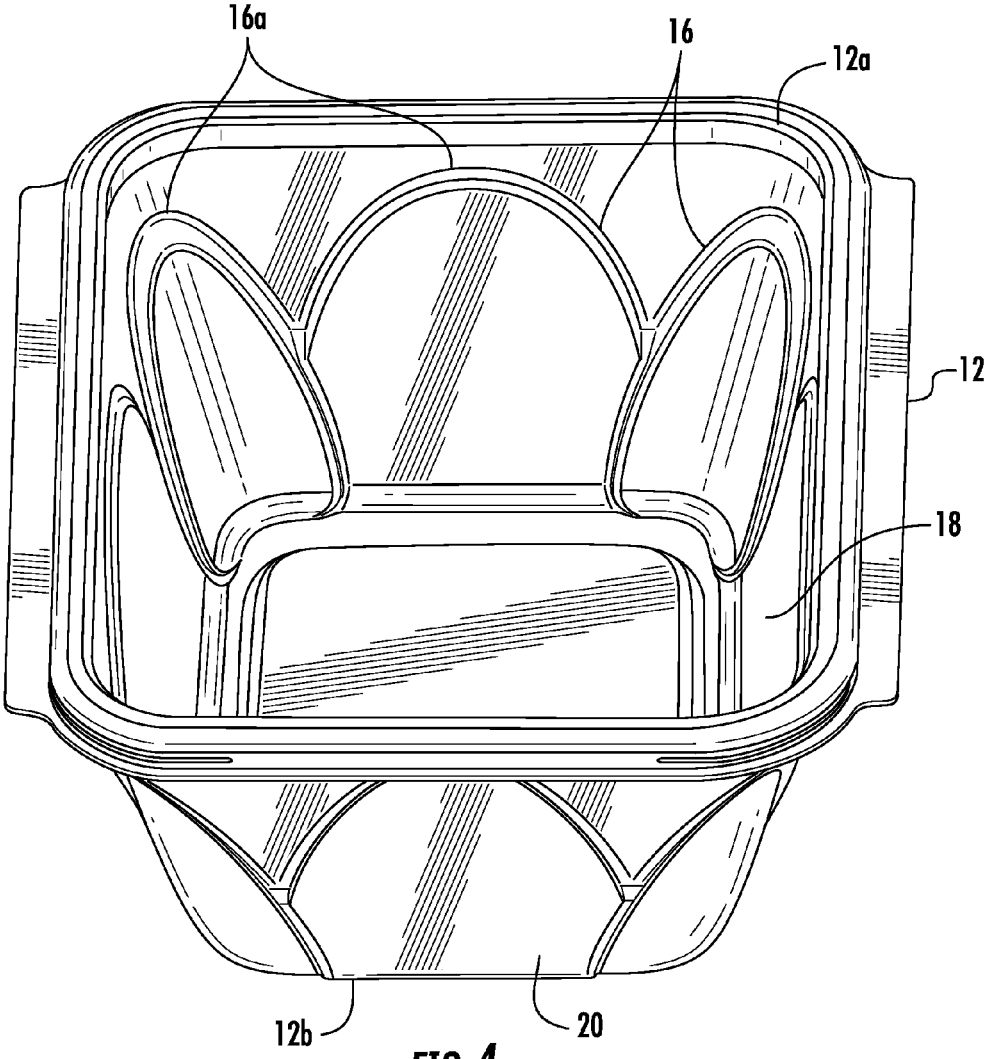
FIG. 4 is a top perspective view of the base of the container of FIG. 1.
Figure 5:
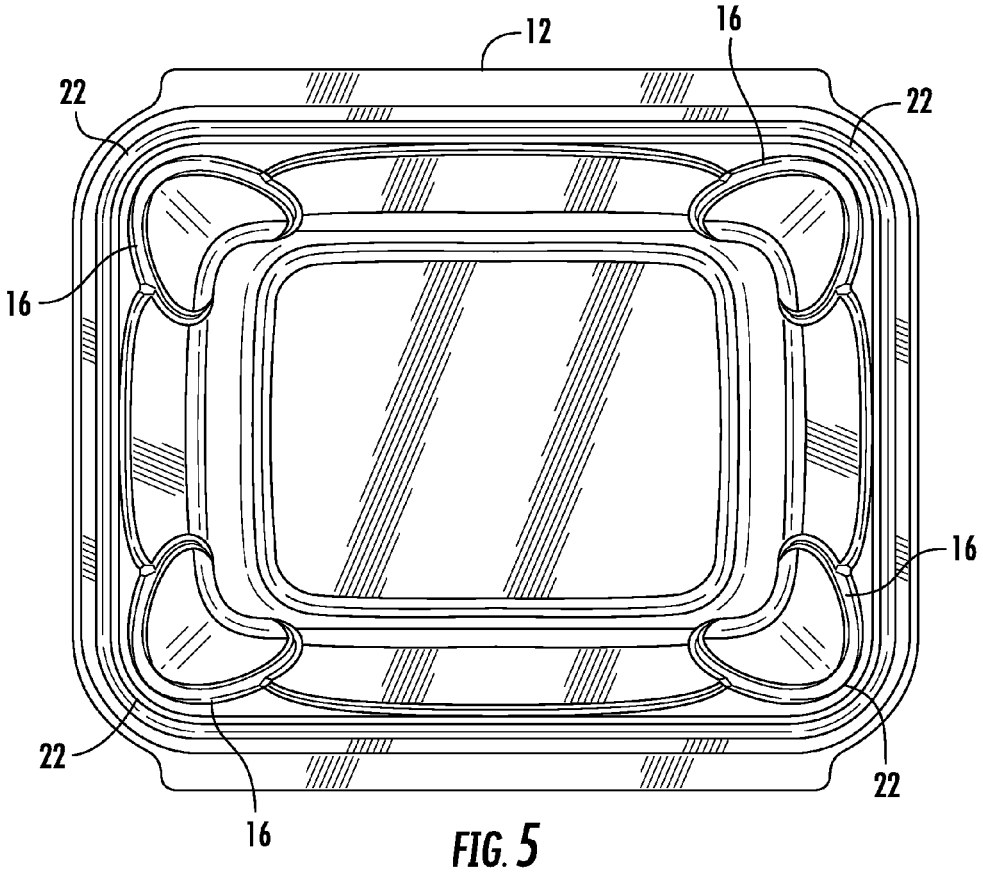
FIG. 5 is a top view of the base of the container of FIG. 1.

In the example shown in the figures, the container 10 of the present invention is generally rectangular in shape so one side 18 is longer than the other 20. To illustrate this, FIG. 2 shows a front elevational view of the longer side 18 while FIG. 3 shows an elevational view of the short side 20. This rectangular configuration is just one example of how the present invention can be used. For example, the container 10 can be formed into a square, round, oval or other shapes depending on the need and application at hand. Still further, the integrated arches 16 can be seen in FIG. 4, which is a top perspective view of the container 10, and FIG. 5, which is a top view of the container 10.

Figure 6:
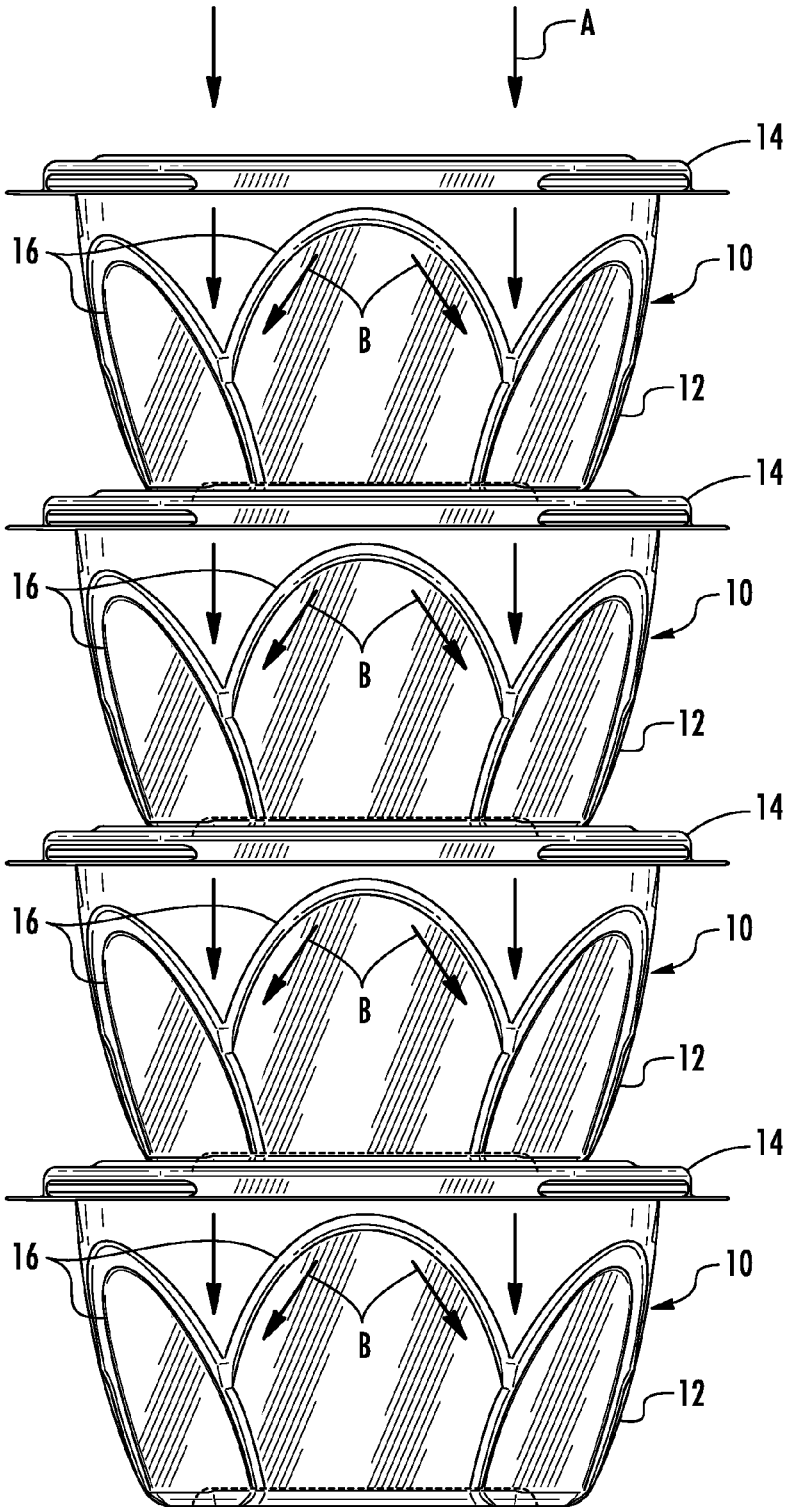
FIG. 6 is a side elevational view of a number of containers of the present invention in a stacked formation.

When a single container 10 is sitting by itself on a support surface, there are essentially no downward forces exerted onto to the top of the lid 14 to the walls 18, 20 of the base 12 of the container 10. However, there is frequently a desire to stack multiple containers 10 on top of each other, as seen in FIG. 6. Such a stacked arrangement is common during shipping and display of the containers 10 at the point of sale. The higher the stack, more and more weight is placed on the container walls 16, 18, as seen by the downward facing arrows, making it more difficult to resist the top loading, particularly for the containers 10 at the bottom of the stack.

More specifically, downward forces as seen by the downward facing arrows, from another container 10 or other object, are exerted on the top of the lid 14 and distributed thereacross and to the side walls 16, 18. If the side walls 16, 18 cannot support the top load that is being delivered, they will collapse and the container will fail risking damage to the contents. The integrated arches 16, with the apex of each arch 16*a* at the top and proximal to the open top end of the base 12, make the walls 16, 18 more rigid, namely in the downward direction onto the edge of the wall 16, 18, which is the general direction of the vector forces received as a result of weight being placed on the top of the lid and container.

The present invention is superior to prior art containers in that is can achieve increased top loading (i.e. stacking weight form above) even though its walls 16, 18 are thin and devoid of added reinforcements, such carbon fiber. For example, the walls 16, 18 may be as thin as 10 mil in thickness, which may be a preferred thickness. The improved structural integrity is achieved by engineering the wall geometries to include integral reinforcement structures so that the increased top loading can still be achieved, even with the thinner walls 16, 18. This enables weight to be saved. As seen in FIG. 6, additional structural integrity is provided, as generally referenced by arrows B, to support the added weight, as referenced by arrows A.

The present invention preferably uses an array of overlapping arches 16. However, this is just one example of the many different types of arch configurations and arrays that can be employed. For example, it is preferred that there is one arch 16 at each corner and another for each side for a total of eight arches 16 when the container 10 is four-sided. Of course, this can be modified to suit the overall configuration of the container 10 and desired amount of additional rigidity. For example, more or less arches 16 can be provided than the number of sides 16, 18 and corners 22, as can best be seen in FIG. 5. Also, for round containers, any desired number of arches 16 could be used. The arches 16 are preferably arcuate in configuration and can extend transversely any desired distance. Such a spanning distance depends on the size and shape of the final container 10 and the regions of the container 10 that are in need of top load structural reinforcement.

Further, while it is preferred that the arches 16 overlap and generally extend from the top edge 12*a* of the container to the bottom edge 12*b* of the container, it is possible that the arches 16 do not overlap at all and also do not extend from the top edge 12*a* to the bottom edge 12*b* of the side 16, 18 of the container 10. As above, the arrangement and configuration of the arches 16 may be modified to suit the purpose of the container 10 and its desired level of rigidity. Also, the depth, namely the amount/extent of the profiling of the plastic or depth of the ridges can be changed to further achieve the desired level of rigidity.

In addition to the providing additional structural top loading reinforcement, the use of the arches 16 also improves the overall appearance of the container 10. The arches 16 shown in the figures are merely an example of such ornamental arches. However, these arches 16 need not be the same in appearance as what is shown to achieve the desired structural reinforcement. As stated above, the arches 16 can be modified significantly and still be within the scope of the present invention.

The container 10 of the present invention is particularly well suited for thermoforming containers 10 out of plastic, which may be transparent, translucent or opaque. Thermoforming, using the appropriate tooling, is so well known in the art that it need not be discussed in detail herein. Suffice it to say that the tooling would be appropriately manufactured to provide the desired wall profiling to achieve the ridged arch formations 16. Containers 10 made out of other materials by other methods can also be achieved using the present invention.

It would be appreciated by those skilled in the art that various changes and modifications can be made to the illustrated embodiments without departing from the spirit of the present invention. All such modifications and changes are intended to be covered by the present invention and any appended claims.

What is claimed is:

1. A structurally reinforced container, comprising:

a base having a bottom, side walls, corners and a top peripheral edge defining an open top end;

a plurality of arches formed in at least one of the side walls and corners; each of the plurality of arches being in the configuration of a ridge having an apex; the apex of the plurality of arches being proximal to the open top end of the base;

a lid residing in communication with the top peripheral edge of the base to releasably close the top end of the base; and wherein at least one arch of the plurality of arches is provided on each of the side walls and the corners; and further wherein adjacent arches overlap; the arches on each of the corners respectively spanning across two adjacent side walls;

wherein arches of the plurality of arches formed in the corners are configured to include an apex and bottom portions where the bottom portions of the at least one arch terminates at the bottom of the base;

wherein the plurality of arches include a first arch and a second arch that overlap with each other; the first arch has a first arch portion that extends in an arcuate path from the apex of the first arch to the base of the container and terminating with a first arch terminal point; the second arch has a second arch portion that extends in an arcuate path from the apex of the second arch towards the base of the container and terminating with a second arch terminal point; wherein the second arch terminal point of the second arch portion terminates at an intersecting point with the first arch portion thereby not extending completely to the base; the second arch terminal point being located further away from the base than the first arch terminal point;

whereby the arches provide reinforcement to the base of the container to increase top load resistance.

2. The container of claim 1, wherein the base has four side walls and four corners and one arch is located on each side wall and each corner of the base.

* * * * *